US009103638B2

(12) United States Patent
Thomas

(10) Patent No.: US 9,103,638 B2
(45) Date of Patent: Aug. 11, 2015

(54) DIVERSIONARY DEVICE

(75) Inventor: Duncan Thomas, Watford Greater London (GB)

(73) Assignee: Thomas Lowe Defence (GB)

( * ) Notice: Subject to any disclaimer, the term of this patent is extended or adjusted under 35 U.S.C. 154(b) by 214 days.

(21) Appl. No.: 13/522,925

(22) PCT Filed: Jan. 17, 2011

(86) PCT No.: PCT/GB2011/050062

§ 371 (c)(1),
(2), (4) Date: Oct. 4, 2012

(87) PCT Pub. No.: WO2011/086388

PCT Pub. Date: Jul. 21, 2011

(65) Prior Publication Data

US 2013/0104766 A1 May 2, 2013

(30) Foreign Application Priority Data

Jan. 18, 2010 (GB) ..... 100709.4

(51) Int. Cl.

| | |
|---|---|
| ***F42B 12/36*** | (2006.01) |
| ***F42B 27/00*** | (2006.01) |
| ***F42B 27/08*** | (2006.01) |
| ***F42B 8/26*** | (2006.01) |

(52) U.S. Cl.
CPC . *F42B 12/36* (2013.01); *F42B 8/26* (2013.01); *F42B 27/00* (2013.01); *F42B 27/08* (2013.01)

(58) Field of Classification Search
CPC ..... F42B 12/36; F42B 12/42; F42B 12/44; F42B 12/46; F42B 8/26; F42B 27/00; F42B 27/08
USPC ..... 102/335, 355, 360, 368, 482, 487, 498, 102/502, 529; 446/400, 401; 434/11
See application file for complete search history.

(56) References Cited

U.S. PATENT DOCUMENTS

| | | | | |
|---|---|---|---|---|
| 3,269,313 | A * | 8/1966 | Willmann et al. | 102/380 |
| 4,932,328 | A * | 6/1990 | Pinkney et al. | 102/482 |
| 5,085,147 | A * | 2/1992 | Gold et al. | 102/486 |
| 5,654,523 | A | 8/1997 | Brunn | |
| 5,824,945 | A * | 10/1998 | Barlog et al. | 102/482 |
| 7,387,073 | B2 * | 6/2008 | Bodley et al. | 102/498 |
| 7,721,651 | B2 * | 5/2010 | Lubbers et al. | 102/498 |

(Continued)

FOREIGN PATENT DOCUMENTS

| | | |
|---|---|---|
| DE | 9213375.4 | 4/1993 |
| WO | 9821541 A1 | 5/1998 |

*Primary Examiner* — James S Bergin
(74) *Attorney, Agent, or Firm* — Chernoff Vilhauer McClung & Stenzel, LLP

(57) ABSTRACT

A diversionary device has a housing containing a pyrotechnic cartridge (24) with an ignitable fuse (52). A firing arrangement includes an ignition cap (60) containing a primer charge (54). Passageways (74, 82) in the housing and ignition cap define a first flow path from the primer charge to a region of the housing in which the fuse (52) is located through which flash from the primer charge can flow to ignite the fuse (52). A further flow path connects said region of the housing with the exterior of the housing to supply the fuse with oxygen for reliable burning. The device may be a multi-burst device containing a plurality of cartridges (24) and the first flow path may include a flash divider (86) for directing a proportion of the flash from a primer charge on to the fuse (52) of each cartridge. The housing may be separable to allow replacement of the cartridges (24).

4 Claims, 10 Drawing Sheets

(56) References Cited

U.S. PATENT DOCUMENTS 7,963,227 B1 * 6/2011 Brunn ..... 102/498
8,091,480 B2 * 1/2012 Lubbers ..... 102/368
2006/0236889 A1 10/2006 Bodley et al.

* cited by examiner

DIVERSIONARY DEVICE

The present invention relates to a diversionary device.

Diversionary devices, sometimes also referred to as stun grenades or distraction devices, are generally intended for use by law enforcement and military personnel to physiologically and psychologically stun an intended victim in high-risk situations. Known diversionary devices generally comprise a housing containing a pyrotechnic charge and a detonation mechanism with a small time delay. When detonated, the known diversionary devices emit a loud noise, pressure and a flash of light to stun the intended victim but without expelling matter that might cause physical injury to the intended victim or anyone else in the vicinity. More recently diversionary devices have been developed which emit multiple bursts of noise, pressure and light rather than a single burst. It is believed that this is more disorientating.

One of the major problems with known diversionary devices is their high cost. Many known diversionary devices can only be used once which makes them prohibitively expensive to use for training purposes. U.S. Pat. No. 4,932,328 describes one attempt to overcome this problem by providing a reloadable stun grenade. However, in the arrangement described, the charge is provided as part of a re-loadable section which includes the charge mounted to a threaded collar for engagement in a threaded opening in a housing and also includes a detonation arrangement including a firing pin. Consequently, the cost of replacing the re-loadable section is still relatively high. The device disclosed in U.S. Pat. No. 4,932,328 is a single burst diversionary device. Known multi-burst devices tend to have more complex charge and detonation arrangements and are either single use devices or can only be re-loaded by specially trained personnel and/or using specialist equipment and so are usually sent back to the supplier or manufacturer for re-loading. This is less convenient and more expensive for the end user than arrangements that can be re-loaded on site with minimal training.

U.S. Pat. No. 7,387,073 B2 discloses an explosive training device which uses a replaceable explosive charge in the form of a cartridge of the type used as bird scarers in an effort to reduce costs. However, in the arrangement disclosed a first end of the cartridge containing a fuse is inserted in a cavity 20 in the housing. The housing cavity is closed at the opposite end by a removable primer head which contains a primer assembly. Accordingly, when the fuse is ignited, the only oxygen available to the fuse is contained within the cavity and may not be sufficient to ensure reliable burning of the fuse. As with U.S. Pat. No. 4,932,328, the device disclosed in U.S. Pat. No. 7,387,073 is a single burst diversionary device.

Typically, diversionary devices are thrown into a room or other closed space through a window or door to disorientate the occupants and allow the law enforcement or military personnel to enter safely. Preferably, diversionary devices should not be propelled about the room or other closed space when the charge is detonated so that they do not cause physical injury. In known diversionary devices, the housing is provided with vents or ports through which the energy generated when the charge explodes can escape without fracturing the housing. Most diversionary devices have a generally cylindrical shaped outer housing which tends to lie on one side on the floor when thrown into a room. If the ports are provided in a base region of the housing there is a risk that the device may be violently lifted off the floor or caused to violently roll or slide along the floor by the force of the explosive charge when detonated. To prevent this happening, many diversionary devices have ports only in one or both longitudinal ends of the housing. An example of this type of arrangement is disclosed in U.S. Pat. No. 4,932,328. However, there is a risk with this arrangement that the device may end up in a position where the ports are located adjacent to a wall of the room and the device could then be propelled by the force of the explosive charge reacting against the wall. U.S. Pat. No. 5,654,523 discloses a stun grenade with vents in end wall regions of the housing but which are angled to direct the explosive force in a radial direction to try and overcome this problem.

The known arrangements are not ideal at preventing diversionary devices from being propelled when the explosive charge is detonated and are relatively complex to manufacture.

It is an object of the present invention to provide a diversionary device which overcomes or at least mitigates the drawbacks of the known diversionary devices.

It is a further object of the invention to provide a diversionary devise which utilises one or more replaceable pyrotechnic cartridges and which is reliable in operation.

It is a yet further object of the invention to provide a diversionary device which can be reloaded more simply and/or more cost effectively than the known diversionary devices.

It is a still further object of the invention to provide a multi-burst diversionary device which can be reloaded more simply and/or more cost effectively than the known reloadable multi-burst diversionary devices.

It is a still further object of the invention to provide a multi-burst diversionary device which is simpler in design and so cheaper and easier to manufacture than known multi-burst diversionary devices.

In accordance with a first aspect of the invention, there is provided a diversionary device comprising a housing having an outer housing portion defining an internal cavity, a replaceable pyrotechnic cartridge mounted in the housing and at least partly located within the internal cavity, the cartridge having a first end containing an ignitable fuse, the housing defining a region in which the first end of the at least one cartridge is located, a firing arrangement mounted to the housing and including an ignition cap containing a primer charge, the housing and ignition cap defining a first flow path from the primer charge to the housing region to provide a fluid path through which a proportion of a flash of heat and pressure given off by a primer charge in the ignition cap when it is fired is can flow to ignite the fuse, in which a further flow path is provided to fluidly connect the fuse with the exterior of the housing.

The provision of a further flow path fluidly connecting the region of housing in which the first end of the cartridge is located with the exterior of the housing ensures that the fuse is supplied with sufficient oxygen to burn reliably.

The housing may comprise at least two portions releasably assembled together and which can be separated to allow replacement of the at least one pyrotechnic cartridge. The outer housing portion may include a hollow side wall region closed at either end by means of an end closure to define the internal cavity. At least one of the end closures may be in the form of an end closure member releasably mounted to the side wall region. The side wall region may be in the form of a generally cylindrical tube and the plurality of vent openings may be defined in the side wall region.

Both end closures may be provided by means of an end closure member releasably mounted to the side wall region or one of the end closure members may be integral with the side wall region. The, or each, releasable end closure member may be mounted to the side wall region by means of a screw thread.

In one embodiment, the firing arrangement is mounted to a first of the end closures, a first passageway being defined through the first end closure and forming part of the first flow path, the ignition cap being mounted so as to close one end of the first passageway and having a second passageway defined there through, the second passageway communicating with the first passageway in the end closure and also forming part of the first flow path. The second passageway may comprise a stepped bore having an enlarged diameter region proximal to an outlet end of the passageway to define a chamber in which carbon given off by the fuse and pyrotechnic charge on detonation can collect.

The ignition cap may comprise a head portion and a spigot portion projecting from the head portion, at least part of the spigot portion being received in a first end region of the first passageway, the primer charge being located in a recess in an outer surface region of the head portion and the second passageway extending from the recess to a distal end of the spigot for communication with the first passageway. The spigot may be in screw threaded engagement with the first end region of the first passageway. The ignition cap has a flange portion which extends over an outer diameter portion of an outer surface of the primer charge to retain the primer charge in the recess.

The first end closure may be integral with the side wall region of the housing outer wall portion.

The first end of the at least one cartridge may be located in a chamber forming part of the first passageway, the further fluid path comprising one or more further passageways defined within the first end closure to fluidly connect the chamber with the exterior of the housing. This arrangement is particularly, but not exclusively, advantageous where the device comprises a single pyrotechnic cartridge the first end of which is a close fit in a chamber forming part of the first passageway in the first end closure so that the cartridge closes the chamber. In this arrangement, air is not able to enter chamber about the cartridge and the other end of the first passageway is closed, or at least restricted, by the ignition cap so that air cannot reliable reach the fuse through the first flow path alone. The, or each, further passageway may open at one end into the internal cavity for fluid communication with the exterior of the housing through the vent openings and at the other end into the first passageway for fluid communication with the chamber and the first end of the at least one cartridge.

The region of the housing in which the first end of the at least one pyrotechnic cartridge is located may be in direct fluid communication with the internal cavity defined by the outer wall portion of the housing for fluid communication with the exterior of the housing through the vent openings. In one embodiment, the housing region comprises a chamber in the first end closure member, the first end of the at least one cartridge locating the chamber with a clearance so that the chamber is in fluid communication with the internal cavity about the at least one cartridge. In an alternative arrangement, the first end of the at least one pyrotechnic cartridge is spaced inwardly from the first end closure member and so is located within the internal cavity for fluid communication with the exterior of the housing through the vent openings.

A plurality of pyrotechnic cartridges may be contained within the housing, each cartridge having a first end containing an ignitable fuse, the first end of each cartridge being located within a region of the housing which is in fluid communication with the exterior of the housing through the further flow path.

The housing may comprise an inner housing portion received within the internal cavity in spaced relation to a side wall region of the outer housing portion, the inner housing portion defining at least one cartridge chamber containing a pyrotechnic cartridge, the cartridge chamber having an outlet arranged to direct substantially all of the force from the cartridge when detonated outwardly in a radial direction relative to a central longitudinal axis of the housing towards the outer wall portion. The inner housing portion may have more than one chamber, each containing a respective pyrotechnic cartridge, each chamber having an outlet arranged to direct substantially all of the force from a pyrotechnic cartridge detonated in the chamber outwardly in a radial direction relative to the central longitudinal axis towards the outer housing portion. The inner housing portion may have three chambers each containing a respective pyrotechnic cartridge. The vent openings may be arranged so that they comprise no more than 50%, or no more than 60% or no more than 70% of the total area of the outer housing portion in regions immediately radially opposite the, or each, chamber outlet. The vent openings may be arranged in zones that are circumferentially offset from the outlet openings of the chambers such that regions of the outer housing portion located immediately radially opposite the, or each, of the chamber outlets have no vents.

The inner housing portion may be generally cylindrical, the, or each, chamber being formed in an outer diameter region of the cylindrical inner housing portion. In one embodiment, the chambers are circumferentially equi-spaced about the inner housing portion, the chambers being generally cylindrical or part cylindrical in shape, each having a longitudinal axis parallel with a central longitudinal axis of the inner housing portion, a radially outer edge of the, or each, chamber breaking through the outer diameter of the inner housing portion to form the outlet.

Where more than one pyrotechnic cartridge is contained in the housing, the device may comprise an arrangement located in the first flow path for configured to divide the flash and to direct a proportion of the flash on to the fuse of each of the cartridges. Where the device has an inner housing portion, the arrangement for dividing the flash may a projection on one end of the inner housing portion which is shaped to direct a proportion of the flash towards the fuse of each of the pyrotechnic cartridges. The projection may have a generally conical portion with an apex positioned substantially centrally of a second end of the first passageway in the first end closure. Grooves may be provided in the outer surface of the conical projection, the grooves being spaced and aligned so as to direct a proportion of the flash on to the fuse of each of the pyrotechnic cartridges. Each groove may be aligned with a cartridge chamber of the inner housing portion.

The device may further comprise a firing arrangement for selectively detonating the primer charge. The firing arrangement may comprise a striker plate having a firing pin, the striker plate being resiliently biased to a firing position in which the firing pin contacts the primer charge, the plate being movable from the firing position to a non-firing position in which the firing pin is spaced from the primer charge against the bias force. The firing arrangement may also comprise a release lever, the lever being movable between a non-release position in which it holds the striker plate in the non-firing position and a released position in which the striker plate is able to move to the firing position under the bias force. The firing arrangement may also comprise a removable safety pin for holding the lever in the non-release position.

The ignition cap may be removably mounted to the first end closure to permit replacement of the primer charge.

In accordance with a second aspect of the invention, there is provided a multi-burst diversionary device comprising a housing having an outer housing portion with a side wall region defining a central longitudinal axis and end closures at opposed ends of the side wall region to define an internal cavity within the outer housing, a mounting arrangement holding two or more replaceable pyrotechnic cartridges within the internal cavity, each cartridge comprising a housing containing a pyrotechnic charge and a fuse with a time delay, the device having an ignition cap mounting a primer charge and a firing arrangement for selectively detonating the primer charge mounted to a first of the end closures, a fluid passage defined in the first end closure through which a proportion of a flash of heat and pressure given off by a primer charge in the ignition cap when it is fired is directed toward the fuse of each cartridge.

The device may comprise a flash divider configured to direct a proportion of the flash from the fluid passage on to the fuse of each of the cartridges. The housing may comprise an inner housing portion located inside the outer housing portion, the inner housing portion having a plurality of chambers, each containing a respective pyrotechnic cartridge. In which case, the flash divider may be a projection on one end of the inner housing portion proximal to an outlet end of the fluid passage and which is shaped to direct a proportion of the flash on to the fuse of each of the cartridges. The projection may have a generally conical portion with an apex aligned substantially centrally of the fluid passage in the first end closure. Grooves may be provided in the outer surface of the conical projection, the grooves being spaced and aligned so as to direct a proportion of the flash on to the fuse of each cartridge in use. Each groove may be aligned with a respective one of the chambers in the inner housing portion.

The housing may be capable of disassembly and reassembly to allow for replacement of the cartridges. At least one of the end closures may be in the form of an end closure member releasably mounted to the side wall region. Each end closure may be in the form of an end closure member releasably mounted to the side wall region. Alternatively, the first end closure may be integral with the side wall region. The second end closure may comprise an end closure member releasably mounted to the side wall region and may be formed integrally with the inner housing portion. The, or each, end closure member may be releasably mounted to the side wall region of the housing by means of a screw thread.

The firing arrangement may comprise a striker plate having a firing pin, the striker plate being resiliently biased to a firing position in which the firing pin contacts the primer charge, the plate being movable from the firing position to a non-firing position in which the firing pin is spaced from the primer charge against the bias force. The firing arrangement may also comprise a release lever, the lever being movable between a non-release position in which it holds the striker plate in the non-firing position and a released position in which the striker plate is able to move to the firing position under the bias force. The firing arrangement may also comprise a removable safety pin for holding the lever in the non-release position.

The time delay of the fuse in each cartridge may be different than the time delay of the fuse in each other cartridge so that the cartridges are detonated sequentially. The pyrotechnic charge in at least one of the cartridges may be of a different composition than the pyrotechnic charge in at least one other cartridge.

In accordance with a third aspect of the invention, there is provided a reloadable multi-burst diversionary device, the device comprising a housing having an outer housing portion having a side wall region and end closures at opposed ends of the side wall region to define an internal cavity, the housing further comprising an inner housing portion received within the outer housing, the inner housing portion defining one or more chambers, each chamber for receiving a replaceable pyrotechnic cartridge comprising a housing containing a pyrotechnic charge and a fuse with a time delay, the device further comprising a removable ignition cap for containing a primer charge and a fluid passage arrangement through which a proportion of a flash of heat and pressure given off by a primer charge when it is fired in the ignition cap is directed into each chamber, the device further comprising a firing arrangement for selectively detonating the primer charge, in which the housing is capable of disassembly and reassembly to enable the cartridges to be replaced after use.

The firing arrangement may comprise a striker plate having a firing pin, the striker plate being resiliently biased to a firing position in which the firing pin contacts the primer charge, the plate being movable from the firing position to a non-firing position in which the firing pin is spaced from the primer charge against the bias force. The firing arrangement may comprise a release lever operatively connected with the striker plate, the lever being movable between a non-release position in which it holds the striker plate in the non-firing position and a released position in which the striker plate is able to move to the firing position under the bias force. The firing arrangement may also comprise a removable safety pin for holding the lever in the non-release position.

The device in accordance with the third aspect of the invention may be constructed in accordance with either of the first and second aspects of the design.

Several embodiments of diversionary devices in accordance with the present invention will now be described, by way of non-limiting example only, with reference to the accompanying drawings, in which.

Figure 1:
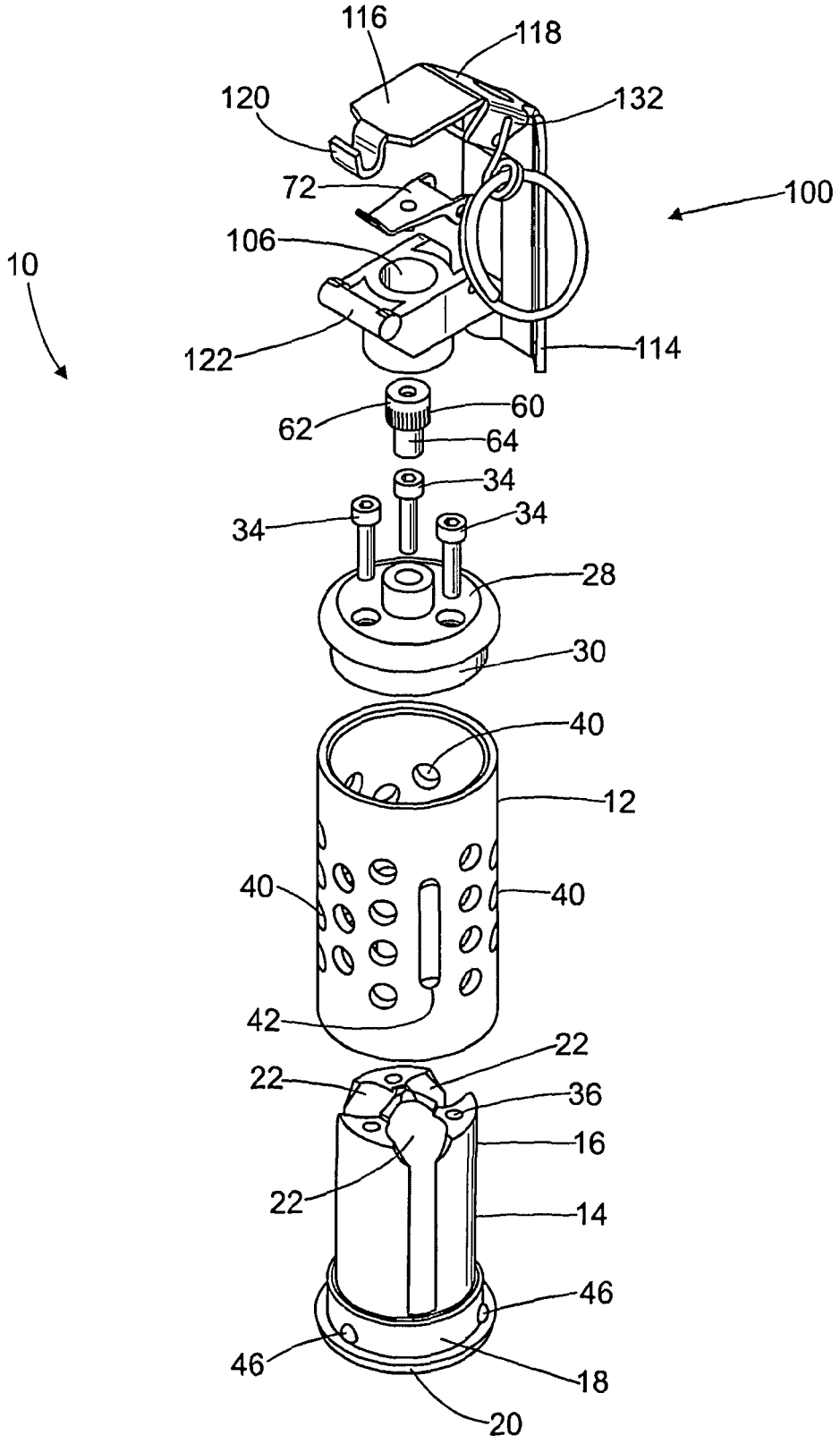
FIG. 1 is an exploded perspective view of an embodiment of a diversionary device in accordance with the invention.

A diversionary device in accordance with an embodiment of the present invention is indicated generally at 10.

The device 10 has a housing comprising an outer housing portion defining an internal cavity. The outer housing portion includes cylindrical, tubular outer body member 12 which defines a side wall region of the outer housing portion, a first end closure 28 for mounting to a first end of the tubular member 12 and a second end closure 18 for mounting to the other, second end of the tubular member 12. The housing also includes an inner housing portion 14 having a generally cylindrical main body portion 16 which locates inside the outer body member 12 and which is formed integrally with the second end closure member 18. In an alternative arrangement, the inner housing portion 14 and the second end closure portion 18 can be separate components and releasably or non-releasably assembled together.

The main body portion 16 of the inner housing portion 14 has an outer diameter which is smaller than the inner diameter of the outer body member 12 whilst the second end closure portion 18 has an outer diameter that is a close fit inside the outer body member 12 and has an annular flange 20 which overlies the end of the outer body member 12, the outer diameter of the flange 20 being substantially the same as the outer diameter of the outer body member 12. Three, longitudinally aligned, generally cylindrical chambers 22 are equi-spaced about the main body portion 16 of the inner member 14 for receiving pyrotechnic effects cartridges 24 containing a pyrotechnic charge. Each chamber 22 has an elongate opening 26 in the outer diameter of the main body portion 16 which is arranged to direct the energy from a cartridge 24 detonated in the chamber radially outwardly towards the outer body member 12 when the cartridge is detonated.

The first end closure member 28 has a circular main body portion 30 which locates inside the first end of the outer body member 12 and a flange 32 which overlies the first end of the outer body member 12, the outer diameter of the flange 32 being substantially the same as the outer diameter of the outer body member 12. The first end closure member 28 is releasably secured to the main body portion 16 by means of three screws 34 which engage with corresponding threaded holes 36 in an end region of the main body portion 16. When the housing is assembled, the outer body member 12 is clamped between the first and second end closures 28, 18.

The components 12, 14, 18, 28 of the housing can be made of any suitable materials capable of containing the blast energy when the cartridges 24 are detonated without fracturing. Typically, the component parts of the housing will be made from steel.

Figure 8:
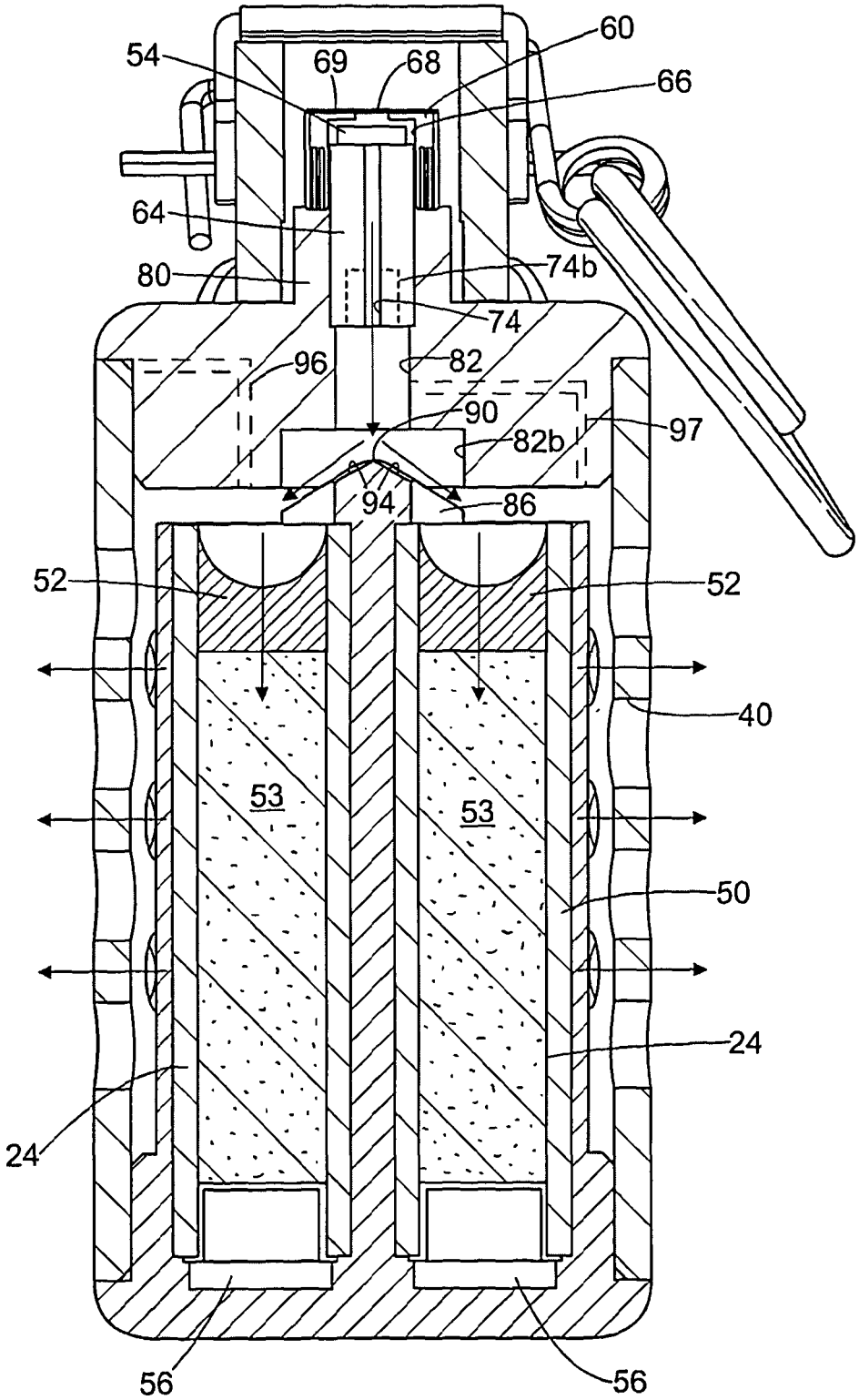
FIG. 8 is a longitudinal cross sectional view through the device of FIGS. 1 to 7.
Figure 9:
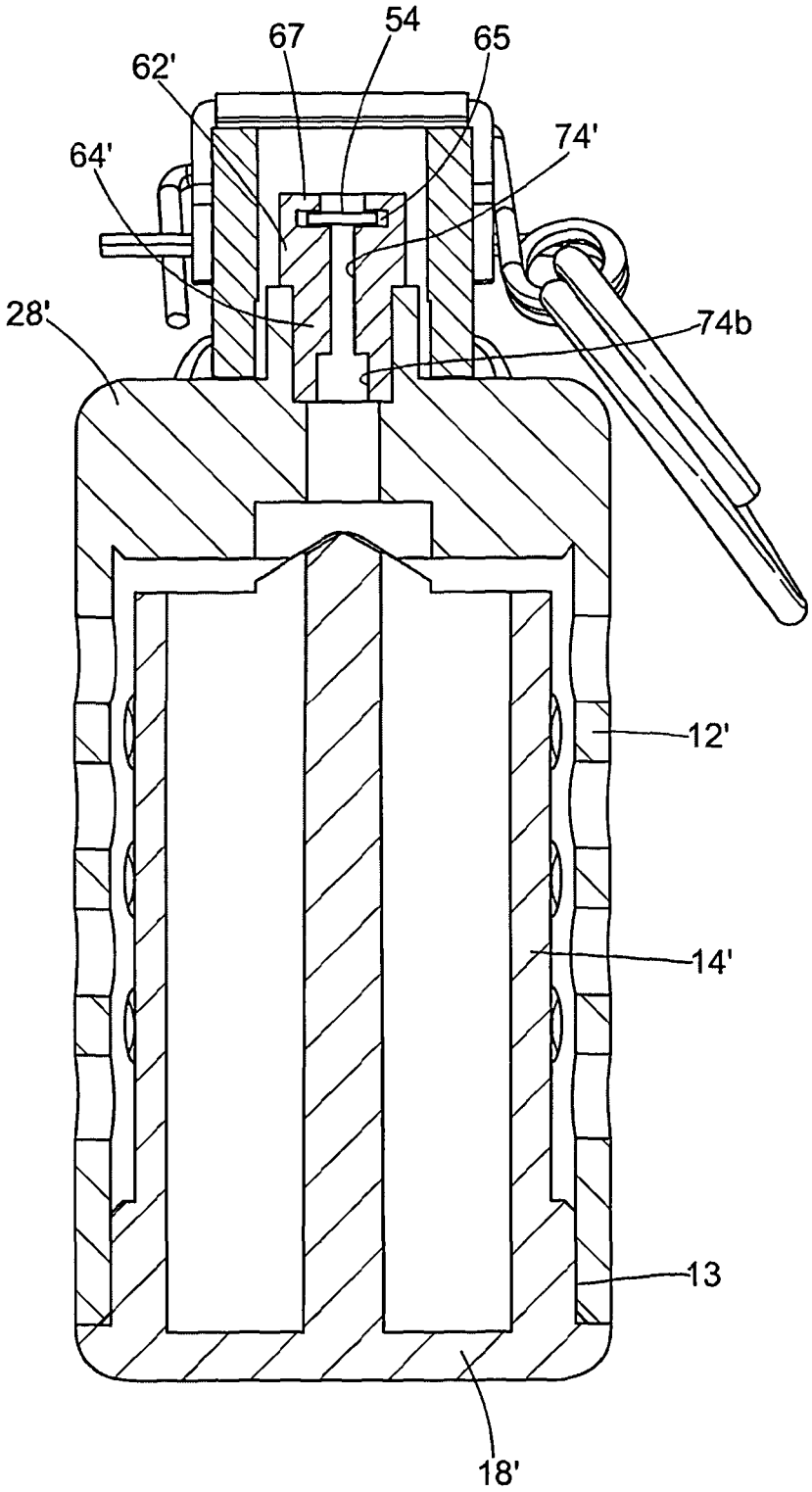
FIG. 9 is a somewhat schematic longitudinal cross sectional view through a further embodiment of a diversionary device in accordance with the invention with the pyrotechnic cartridges omitted.

Other arrangements for holding the component parts of the housing together can used rather than the screws 34 described above. For example, each of the end closure members 18, 28 may engage the with the outer body member 12 by means of a screw thread. In a further alternative arrangement of the device 10' as illustrated in FIG. 8, the side wall region 12' of the outer housing can be formed as single integral component with the first end closure 28' or the two could be manufactured as separate components releasably or non-releasable assembled together. In this case, the housing would have only two components that need to be separated to replace the cartridges 24, a first component comprising the first end closure 28' and the tubular side wall region 12' and a second component comprising the inner housing portion 14' and the second end closure 18'. Forming the first end closure 28' integrally with a tubular side wall region 12' of the outer housing portion may be advantageous in providing a structurally more robust housing which is particularly suitable for use with more powerful explosive charges. In the embodiment as illustrated in FIG. 8, the second end closure 18' engages with the side wall region 12' by means of a screw thread 13.

Figure 6:
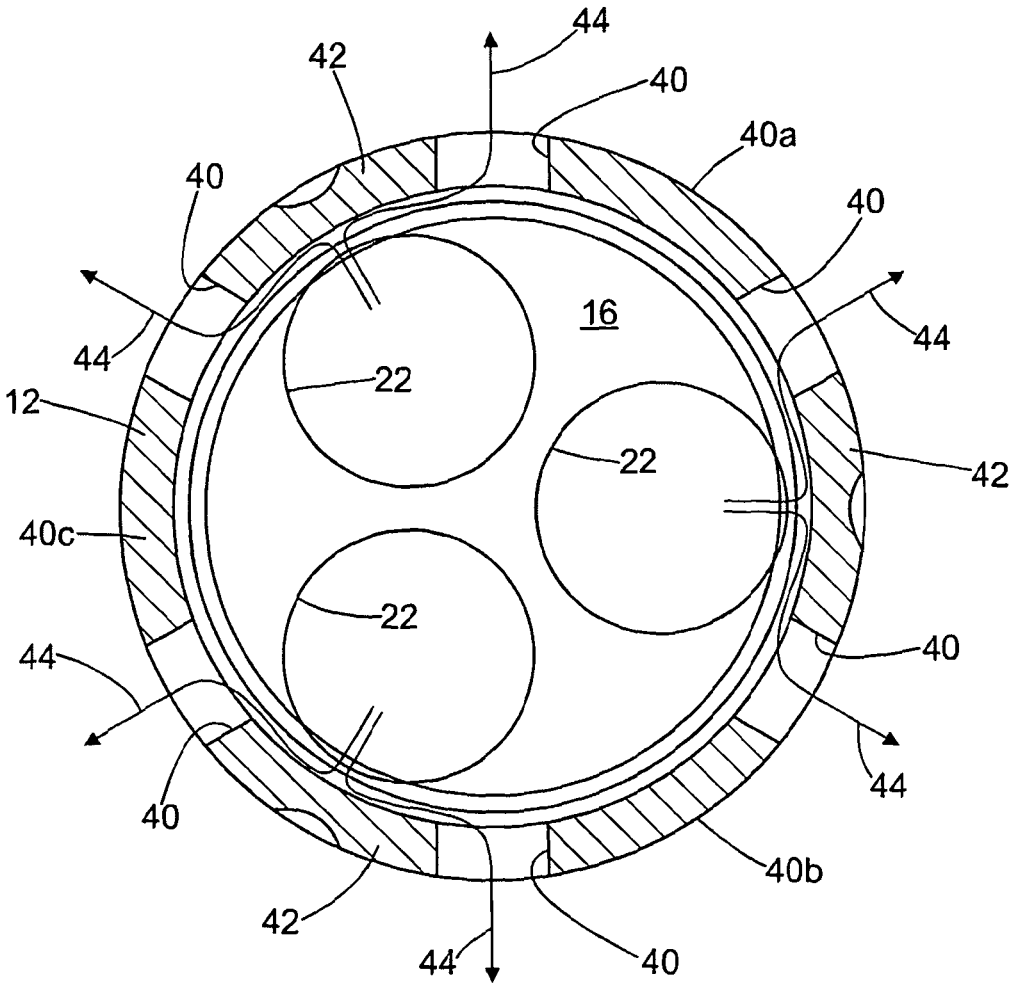
FIG. 6 is a lateral cross sectional view through the device of FIGS. 1 to 5, taken on line X-X in FIG. 3 and shown in an enlarged scale.
Figure 7:
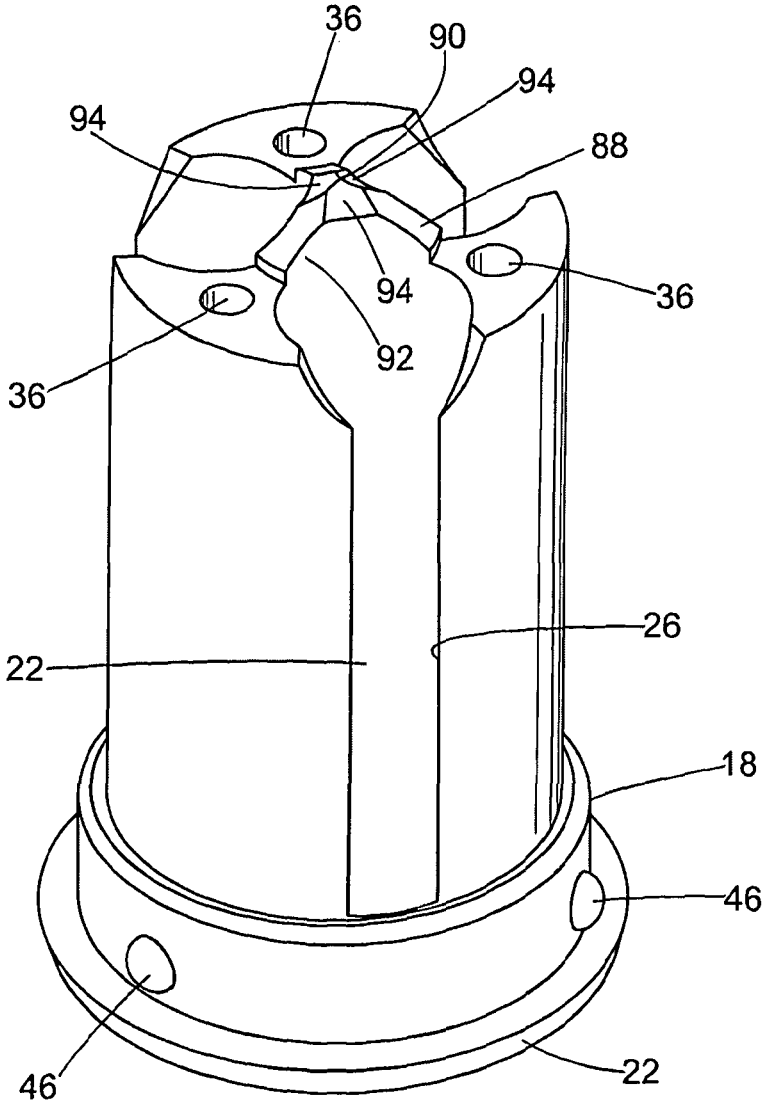
FIG. 7 is a perspective view of an inner body form part of the device of FIGS. 1 to 6.

The side wall region of the outer housing portion as defined by the outer body member 12 has a number of vents or ports 40 through which the energy, sound, light, and gasses released when the pyrotechnic cartridges 24 are detonated can pass. The ports 40 are arranged in three distinct venting zones 40*a*, 40*b*, 40*c*, which zones are equi-spaced about the circumference of the outer body member 12. Regions of the outer body member 12 between the venting zones have no vents 40 and will be referred to as deflection regions 42. The outer body member 12 and the inner body portion 14 are orientated so that the venting zones 40*a*, 40*b*, 40*c* are circumferentially offset from the openings 26 of the cartridge chambers, such that the openings 26 are each aligned in radial opposition with one of the deflection zones 42. As a result, when a cartridge 24 is detonated, the energy and the gasses of combustion released cannot pass directly out of the housing in a radial direction but are deflected by the respective deflection zone 42 to move circumferentially around the inside of the outer body member 12, passing through a gap between the inner surface of the outer body member 12 and the outer diameter of the main body portion 16 of the inner body member 14 as indicated by the arrows 44 in FIG. 6. As illustrated in FIG. 6, the energy and gasses released when one of the cartridges 24 is detonated will tend to be divided into substantially equal parts which move in opposite circumferential directions. Whilst the bulk of the energy and gasses released when a cartridge 24 is detonated will tend to pass out of the vents 40 immediate adjacent the respective deflection zone 42, some will travel further about the inside of the outer member to pass out of vents which are further from the chamber opening 26.

The above described arrangement for internally deflecting the explosive forces generated when a cartridge 24 is detonated has a number of advantages. Firstly, the explosive force is divided by the respective deflection region 42 so that the full force generated when a cartridge 24 is detonated cannot pass though a single vent or row of vents but is spread through a number of circumferentially spaced vents. This dissipates the energy and reduces the risk of the device 10 being propelled by the force of the blast. Secondly, because substantially equal proportions of the energy and gasses released are deflected to travel in opposite circumferential directions to pass out of vents 40 circumferentially equi-spaced either side of the chamber opening 26, the reactive forces tend to cancel one another out. This further reduces the risk of the device 10 being physically propelled when a cartridge 24 is detonated.

To ensure correct orientation of the inner body member 14 relative to the outer body member 12, the second end closure portion 18 has three indexing pins 46 equi-spaced about an outer diameter. The pins 46 engage in corresponding grooves (not shown) formed in the inner surface of the outer body member 12 so as to ensure the deflection zones 42 are positioned opposite the openings 26 of the chambers. It will be appreciated that other arrangements which will only allow the inner housing portion 14 to be assembled to the outer body member in the correct circumferential orientation can be adopted.

Whilst it is appropriate in certain applications for the side wall region 12 of the outer housing portion to have deflection zones 42 having no vent ports 40 radially opposite each cartridge chamber outlet 26 as described above, the applicant has found that significant benefits can still be obtained if the vents are arranged so that in the zones immediately opposite the outlet opening 26 of each cartridge chamber, the vents comprise no more than 70%, or no more than 60%, or no more than 50% of the total wall area where two or more pyrotechnic cartridges are provided in the housing. This means that there is still a significant proportion of the side wall in these zones which is closed and which acts to deflect a proportion of the energy and the gasses of combustion released when a cartridge is detonated circumferentially within the outer housing. The proportion of the energy and the gasses of combustion which are deflected circumferentially will increase as the percentage of the wall area comprised by the vents decreases and it is possible to vary the proportion accordingly to achieve the desired effect.

The vent openings 40 need not be circular holes as in the present embodiment but could take the form of elongate slots.

Figure 10:
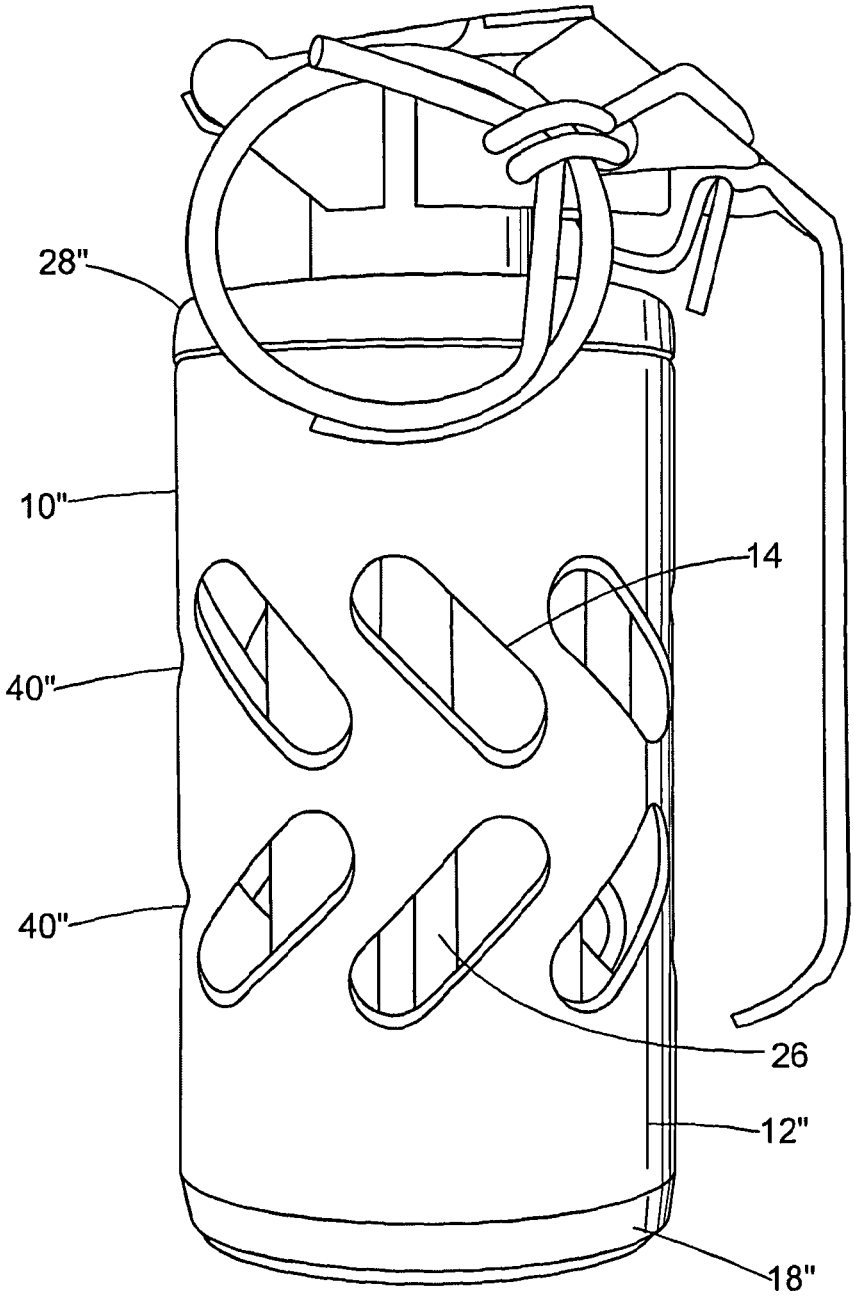
FIG. 10 is a side view of a still further embodiment of a diversionary device in accordance with the invention illustrating an alternative arrangement for the vent openings.

FIG. 10 for example illustrates a further embodiment of a diversionary device 10" in accordance with the invention in which the vent openings 40" are provided in the form of two circumferential rows of slots which are angled relative to the longitudinal axis of the housing and each other to form a chevron or V like pattern. It will be appreciated that other arrangement for the vent holes could be adopted.

The cartridges 24 each comprise a cylindrical housing 50 containing a fuse 52, a pyrotechnic charge 53 and an end closure 56. The cartridges may be similar to the so called "flash-bang" cartridges that are commercially available and used typically for scaring birds. The cylindrical housing 50 may be made of paper or cardboard or the like but any suitable material can be used. The pyrotechnic charge 53 may be any suitable composition which produces the required combination of sound, light and pressure. A differently composed pyrotechnic charge 53 may be used in each of the cartridges 24 in the device 10 to create different effects. For example, the three cartridges 24 may be arranged to fire sequentially, with each successive cartridge producing a louder noise more light and more pressure. This gives the impression that the device 10 is moving closer to the victim even though the device is substantially stationary.

The term "explosive" is used here to include low or "deflagrating" explosives in which the explosion propagates through the material through an accelerated burning or "combustion" process. References to a "pyrotechnic" charge should be understood to include an "explosive" charge including low or deflagrating explosives.

The length and composition of the fuse 52 determines the time delay between ignition of the fuse and detonation of the explosive charge. To provide a multi-burst effect, each of the cartridges in the device 10 can be provided with a fuse 52 having a different time delay so that they are detonated sequentially. The cartridges 24 are positioned in the cartridge chambers 22 with first ends containing the fuses 52 directed toward the first end closure member 28.

A primer charge 54 for igniting the fuses 52 of the cartridges 24 is housed in an ignition cap 60. The ignition cap 60 has a main body or head 62 and a spigot 64. The main body 62 is generally circular and has a central, semi-blind bore 66. The bore 66 is threaded and a small opening 68 is provided through an upper end wall region 69 of the main body through which a firing pin 70 forming part of a striker plate 72 can pass. The spigot 64 is cylindrical in shape having a thread on its outer surface and a central through bore 74. The thread on the spigot 64 corresponds with the thread in the bore 66 of the main body so that one end of the spigot can be screwed into the bore to form the ignition cap. The primer charge 54 is located in bore 66 between an end of the spigot 64 and the upper end wall region 69 of the main body. The primer charge is thus held captive in the ignition cap and will not become a projectile when the device is detonated.

The ignition cap can be made of any suitable materials such as brass or steel or a combination of the two. In one embodiment, the main body 62 is made of brass and the spigot 64 is made of steel. In a further alternative embodiment, the ignition cap can be formed as a single unitary item comprising a head and a threaded spigot projecting from the head as illustrated in FIG. 8. In this embodiment, a recess 65 is formed in the outer surface of the head 62' in which the primer charge 54 is located with the bore 74' extending from the base of the recess to the distal end of the spigot portion 64'. To hold the primer charge in the recess, a portion of the ignition cap material can be spun over, or otherwise deformed, after the primer charge has been inserted in top the recess to form a radial flange 67 which overlies an outer diameter portion of the primer charge. Whilst the ignition cap is typically replaced after each detonation of the device, it is preferred that the body of the ignition cap remains intact when the primer charge is detonated so as to retain the primer charge in place. This reduces the risk of injury which might be caused by the primer charge or parts of the ignition cap housing being expelled.

The first end closure 28 has a central boss 80 on its outer face and a central through bore 82. An outer end region **82*a* of the bore is threaded to receive the end of the spigot 64 to mount the ignition cap to the first end closure member. The bore 82 has an enlarged diameter portion 82*b* where it opens at the inner face 84 of the first end closure member to form an ignition chamber. When the primer charge 54 is hit by the firing pin 70 it explodes producing a flash of pressure and heat. Part of the flash travels down the bore 74 in the spigot and the bore 82 through the first end closure member to enter the ignition chamber 82*b* from where it is directed down onto the fuses 52 of the pyrotechnic cartridges 24 to ignite the fuses 52. Once ignited, the fuses burn and detonate the charge 54** after a set time delay.

In a further alternative arrangement, the spigot 64 can be formed as an integral part of the first end closure member. The spigot 64 could take the form of a threaded boss projecting from the top of the central boss 80.

To ensure that the fuses 52 of all three cartridges 24 are ignited from a single flash, the device 10 has a flash divider 86 that is shaped so as to direct a portion of the flash from primer charge into each of the chambers 22 and onto the fuses of each cartridge. In the present embodiment, the flash divider is provided by a formation 86 on the upper surface of the main body portion 16 of the inner body member which projects towards the ignition chamber **82*b*. The flash divider can be any suitable shape but in the present embodiment an upper portion 88 of the flash divider is generally conical in shape leading to an apex 90 located centrally inside the ignition chamber 82*b*. Parts 92 of the conical portion 88 are cut away where the chambers 22 are formed. The flash divider 86 has three grooves 94 in the outer surface of the conical region, each of which extend from a position close to the apex 90 towards a respective one of the chambers 22**.

Figure 2:
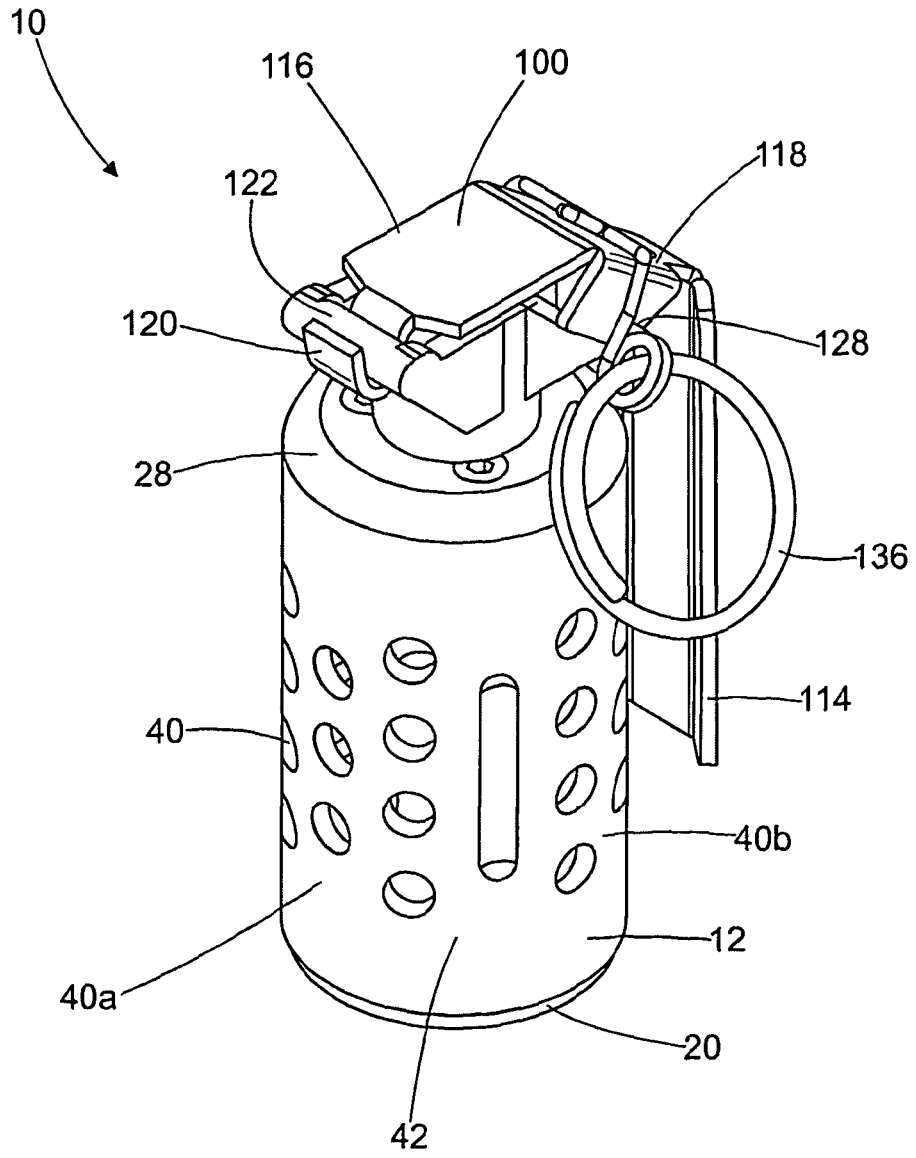
FIG. 2 is a perspective view of the device of FIG. 1 in an assembled condition.
Figure 3:
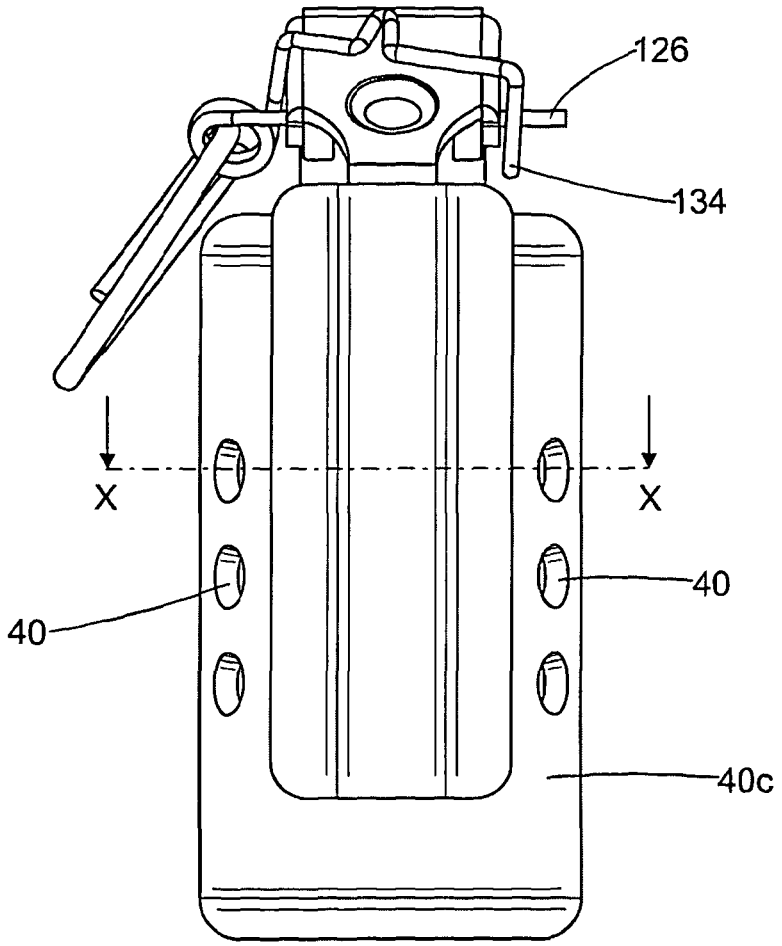
FIG. 3 is a view from the rear of the device of FIGS. 1 and 2.
Figure 4:
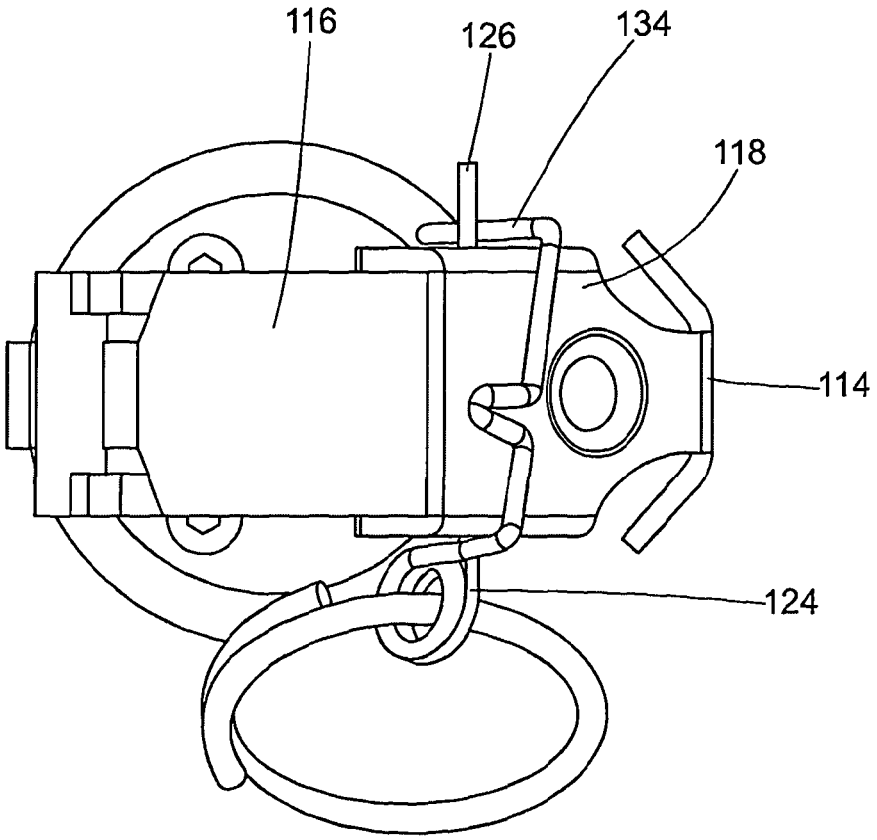
FIG. 4 is a view from above of the device of FIGS. 1 to 3.
Figure 5:
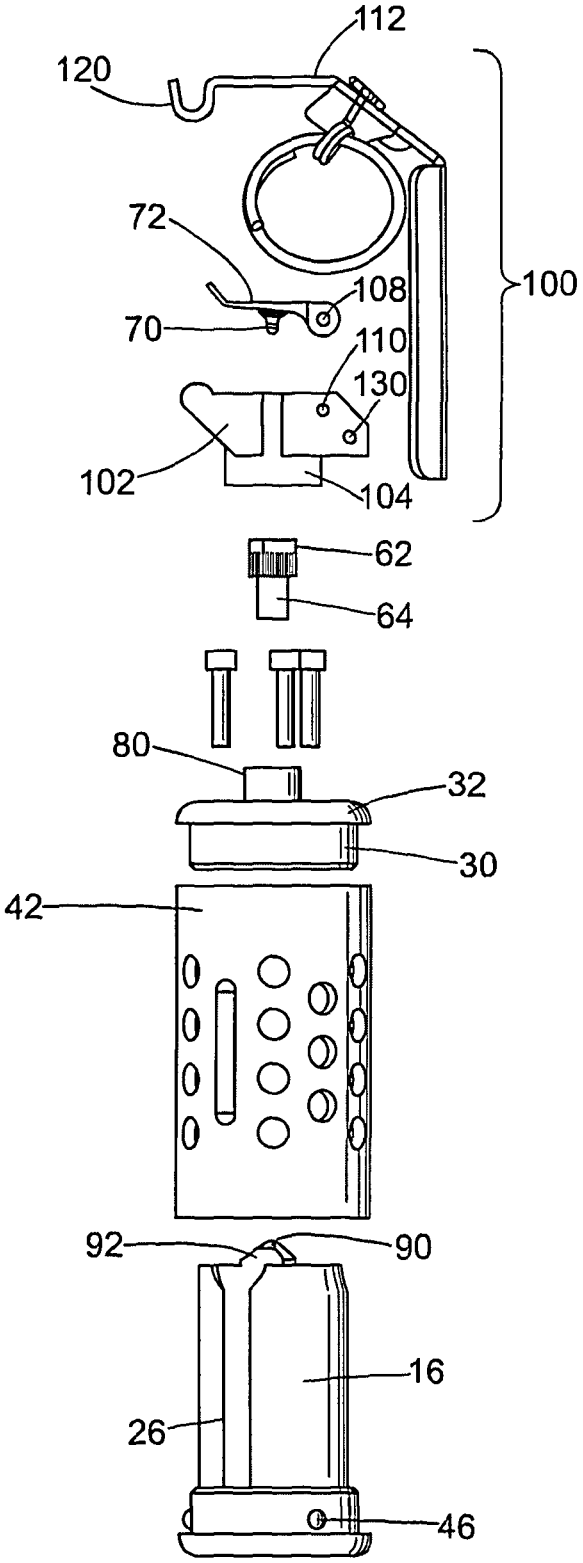
FIG. 5 is an exploded view of the device of FIGS. 1 to 4 taken from one side

To fire the primer charge 54, the device has a striker plate and release lever assembly, indicated generally at 100, which is mounted to the first end closure member 28. This comprises a lever mounting body 102 having a cylindrical portion 104 with a central bore 106. The bore 106 is threaded for engagement with a corresponding thread on the outer surface of the boss 80 on the first closure member. The striker plate is pivotally mounted to the lever mounting body 102 by means of a pin (not shown) which engages in corresponding holes 108, 110 in the striker plate 72 and the mounting body 102. The striker plate carries the firing pin 70 and is biased by means of a spring (not shown) to a firing position in which the pin enters the opening 68 in the firing cap to impact on the primer charge. The striker plate 72 can be pivoted about the pin to a non-firing position against the bias of the spring held in the non-firing position by a lever 112. The lever 112 has a main lever section 114, a second lever section 116 which extends generally at right angles to the main lever section 114 and an angled section 118 which interconnects the main and second lever sections. The lever has a hook 120 at the free end of the second lever section 116 which engages with a cylindrical axle portion 122 of the lever mounting body 102 so that the lever 112 can be pivoted about the axle portion 122 between a non-released position and a released position. In the non-released position, as shown in FIG. 2, the second lever section 116 extends over the top of the lever mounting body 102 in close proximity thereto and the main lever section 114 extends generally parallel to the outer body portion 12 of the housing. In this position, the lever is able to hold the striker plate 72 in the non-firing position against the bias of the spring.

A safety pin 124 is provided to retain the lever in the non-released position until the device is required for use. The safety pin has a first leg 126 which passes through corresponding holes 128, 130 in side wall regions 132 of the lever and the lever mounting body 102 to prevent the lever from pivoting about the axle portion 122 from the non-released to the released position. A second leg 134 of the safety pin is generally U-shaped passes over the angled section 118 of the lever with one end of the U-shape engaging behind the first leg 126. The safety pin 124 has a ring 136 which can be grasped by a user to remove the pin. The second leg 134 prevents the safety pin from being withdrawn by simply pulling the pin outwardly, rather the pin must first be twisted, anticlockwise or to the left as shown in FIG. 2, to disengage the second leg 134 before the pin can be pulled to disengage the first leg 126.

Operation of the device will now be described. To use the device 10, the user holds the device in one hand about the outer body portion 12 and so as to hold the main lever section 114 against the outer body. The safety pin 124 is then removed. Once the safety pin 124 is removed, the device can be thrown towards the intended target releasing the lever. When the lever 112 is released, the spring biases the striker plate 72 toward the firing position pivoting the lever 112 about the axle portion 122. The lever may disengage from the device completely. As the striker plate 72 approaches the firing position, the firing pin strikes the primer charge 54 causing a flash to pass down the bore 74 in the spigot 66 of the ignition cap and the bore 82 of the first end closure member to enter the ignition chamber 82*b*. From the ignition chamber, the flash is divided by the flash divider 86 so that a portion of the flash enters each cartridge chamber 22 to simultaneously ignite the fuses 52 of the three cartridges 24. The charges 53 in each of the cartridges are then detonated sequentially after respective time delays determined by the fuses 52.

After use, and once the device 10 has cooled sufficiently, it can be recollected and reloaded. The lever and striker plate assembly 100 is removed and reset to hold the striker plate in a non-released position and the safety pin 124 inserted. The ignition cap 60 is removed from the first end closure member 28 and replaced with a fresh cap. Alternatively, the ignition cap can be disassembled and the primer charge 54 replaced. To replace the cartridges, the screws 34 are removed and the housing disassembled. Once new cartridges have been placed in the cartridge chambers 22, the housing is reassembled with a new or recharged ignition cap and the reset lever and striker plate assembly 100 is fitted. The device 10 is then ready for further use. The precise order in which the above tasks are carried out can of course be varied.

Where the end closures 18, 28 are attached to the outer body portion 12 by means of a screw thread, they can be simply unscrewed to disassemble the housing and screwed together to re-assemble the housing after the cartridges have been replaced. Where the first end closure 28 is integral with a side wall region 12 of the outer housing, the housing is disassembled by simply unscrewing and removing the second end closure 18 together with the inner housing portion 14 in which the cartridges are held. The cartridges can then be replaced and the housing re-assembled.

It can be seen that re-loading of the device 10 in accordance with the invention is a comparatively simple procedure that requires no specialised tools and only minimal training to be carried out safely. In addition, only the cartridges 24 and the firing cap 60 need be replaced. These components are relatively cheap to manufacture and supply.

During detonation of the device once the fuses 52 have been lit, it is important that sufficient air is available to enable the fuses to burn reliably, safely and effectively until the explosive charges 53 have been detonated. This can be achieved in a number of ways. In the present embodiment, the upper end of the inner body member 14 where the fuses are located is spaced from the first end closure member 28 so that air is able to circulate from outside the housing through the vents 40 to enter the cartridge chambers 22 about the fuses 52. However, in alternative arrangements such spacing may not be possible or may be insufficient to ensure adequate ventilation. In this case, air passages may be formed in the first end closure member to allow air to enter the cartridge chambers 22 adjacent the fuses. Such an arrangement is indicated schematically by the dashed lines 96 in FIG. 8.

The provision of a flow path for fluidly connecting a region of the housing in which the fuse is located with the exterior of the housing in accordance with a first independent aspect of the invention is not limited to application in a diversionary device in accordance with the present embodiment but can be applied in any diversionary device in which the explosive charge has an ignitable fuse requiring an adequate supply of oxygen to burn reliably. For example, in known single burst diversionary devices which use a replaceable cartridge, a first end of the cartridge in which the fuse is located is typically inserted into part of a first passageway in the first end closure through which flash from a primer charge in an ignition cap can travel to ignite the fuse. The first end is usually a tight fit in the first passageway to hold the cartridge in place. In this arrangement, the first passageway is closed at one end by the cartridge and at the other end by the ignition cap and the primer charge. Even after detonation of the primer charge, the other end of the first passageway may be closed or at least restricted so that there is insufficient air in the first passageway to ensure reliable burning of the fuse. A further flow path to allow a sufficient supply of air can be provided in this case by forming further passageways in the end closure to fluidly connect the first passageway downstream from the ignition cap with the exterior of the housing. In one arrangement, one or more further passageways are provided which open at one end at an inner face of the end closure into the internal cavity of the housing and at the other end into the first passageway in which the first end of the cartridge is held. In this way air can be drawn into the first passageway from the internal cavity through the further passageways and consequently from the exterior of the housing through the vents. The position of such a further passageway is illustrated schematically at 97 in FIG. 8. In the arrangement as shown, it can be seen that fuse of a single cartridge 24 inserted into the enlarged region 82*b* of the bore in the first end cap can be supplied with air drawn from the exterior of the housing through the internal cavity and the vents 40. The further passageways 97 could extended directly to the exterior of the housing but it is preferred if they open into the internal cavity as this reduces the chances of water or other foreign matter entering the further passageway and contaminating the fuse.

In an alternative arrangement, one or more cartridges may be held in place by a suitable holder, such as the inner housing portion 14, located inside the outer housing portion of a diversionary device so that the first end of the cartridge can be located in the first passageway in the first end closure with a clearance so that the air can flow into the first passageway about the cartridge from the internal cavity which is fluidly connected with the exterior by the vents. In this arrangement, the first end of the cartridge would typically be located in an enlarged region of the first passageway which forms a chamber.

When a pyrotechnic cartridge is detonated it gives of carbon which will collect the fluid passageways 82 in the first end closure 28. After repeated use, these carbon deposits may build up an restrict the passageways. To alleviate this problem, the bore 74' in the ignition cap can be provided with an enlarged diameter region 74*b* as illustrated in FIG. 8 at the outlet end of the bore to form a chamber in which the carbon can collect. In this way, a significant proportion of the carbon is removed after each use when the ignition cap is replaced.

Terms such as "upper" and "lower", "top" and "bottom" as used herein refer to the device 10 and its component parts or parts thereof when the device is orientated as shown in the drawings with the striker plate and lever assembly 100 uppermost. It will be appreciated, however, that the device can be held and used in other orientations and such terms should be understood and construed in this context.

It will be appreciated that various changes and modifications can be made to the embodiment of the device 10 described above without departing from the scope of the invention. For example, the device could be constructed to hold more or fewer than three pyrotechnic cartridges. It will also be appreciated that certain inventive aspects of the device 10 could be adopted independently of other inventive aspects. For example, the concept of igniting a number of cartridges from a single primer charge using a flash divider could be adopted without use of the arrangement for deflecting the explosive force from the cartridges circumferentially within the outer body member. Conversely, the concept of deflecting the explosive force internally could be advantageously adopted in multi-burst diversionary devices having alternative firing and charge arrangements from those used in the device 10 or in a single burst diversionary device. Accordingly, patent protection may be sought for various aspects of the device as disclosed herein either independently or in combination.

The invention claimed is:

1. A multi-burst diversionary device comprising a housing having an outer housing portion with a side wall region defining a central longitudinal axis and end closures at opposed ends of the side wall region to define an internal cavity within the outer housing, a mounting arrangement holding two or more replaceable pyrotechnic cartridges within the internal cavity, each cartridge comprising a housing containing a pyrotechnic charge and a fuse with a time delay, the device having an ignition cap mounting a primer charge and a firing arrangement for selectively detonating the primer charge mounted to a first of the end closures, a fluid passage defined in the first end closure through which a proportion of a flash of heat and pressure given off by said primer charge in the ignition cap when it is fired is directed toward the fuse of each cartridge, the mounting arrangement comprising an inner housing portion located inside the outer housing portion, the inner housing portion having a plurality of chambers, each containing a respective pyrotechnic cartridge, the device having a flash divider for directing a proportion of the flash from the fluid passage on to the fuse of each of the cartridges, the flash divider comprising a projection on one end of the inner housing portion proximal to an outlet end of the fluid passage and which is shaped to direct a proportion of the flash on to the fuse of each of the cartridges.

2. A multi-burst diversionary device as claimed in claim 1, in which the projection has a generally conical portion with an apex aligned substantially centrally of the fluid passage in the first end closure.

3. A multi-burst diversionary device as claimed in claim 2, in which grooves are provided in the outer surface of the conical projection, the grooves being spaced and aligned so as to direct a proportion of the flash on to the fuse of each cartridge in use.

4. A multi-burst diversionary device as claimed in claim 1, in which the second end closure comprises an end closure member integral with the inner housing portion, the end closure member being releasably mounted to the side wall region.

* * * * *